US005856078A

United States Patent [19]

Wang et al.

[11] Patent Number: 5,856,078

[45] Date of Patent: Jan. 5, 1999

[54] ANTIHALATION UNDERCOAT LAYER WITH IMPROVED ADHESION AND REDUCED FINISHING DIRT

[75] Inventors: Yongcai Wang, Penfield; Alfred B. Fant; Gary W. Visconte, both of Rochester, all of N.Y.

[73] Assignee: Eastman Kodak Company, Rochester, N.Y.

[21] Appl. No.: 820,320

[22] Filed: Mar. 12, 1997

[51] Int. Cl.[6] ..... G03C 1/815; G03C 1/93

[52] U.S. Cl. ..... 430/512; 430/527; 430/536; 430/537; 430/931

[58] Field of Search ..... 430/512, 931, 430/961, 546, 536, 527, 537

[56] References Cited

U.S. PATENT DOCUMENTS

| | | | |
|---|---|---|---|
| 2,739,888 | 3/1956 | Sawdey | 430/513 |
| 3,215,530 | 11/1965 | Riebel et al. | 430/512 |
| 3,352,681 | 11/1967 | Ohi et al. | 430/512 |
| 3,707,375 | 12/1972 | Ohi et al. | 430/517 |
| 4,199,363 | 4/1980 | Chen | 430/512 |
| 4,247,627 | 1/1981 | Chen | 430/512 |
| 4,304,769 | 12/1981 | Chen | 424/218 |
| 4,368,258 | 1/1983 | Fujiwhara et al. | 430/512 |
| 5,536,628 | 7/1996 | Wang et al. | 430/531 |
| 5,594,047 | 1/1997 | Nielsen et al. | 430/517 |
| 5,683,861 | 11/1997 | Vishwakarma et al. | 430/512 |

*Primary Examiner*—Richard L. Schilling
*Attorney, Agent, or Firm*—Carl F. Ruoff

[57] ABSTRACT

The present invention is a silver halide photographic element which includes a support, at least one light sensitive silver halide emulsion layer, and an antihalation undercoat layer interposed between the at least one light sensitive silver halide layer and the support. The antihalation undercoat layer includes a hydrophilic binder and an ultraviolet ray absorbing polymer particle having a mean size of greater than 0.01 $\mu$m. The ultraviolet ray absorbing polymer particle includes an ultraviolet ray absorber and a polymer derived from monomer A and less than 10 weight % of monomer B, wherein monomer A represents ethylenically unsaturated monomers which form substantially water insoluble homopolymers, and monomer B represents ethylenically unsaturated monomers capable of forming water soluble homopolymers.

12 Claims, No Drawings

ANTIHALATION UNDERCOAT LAYER WITH IMPROVED ADHESION AND REDUCED FINISHING DIRT

FIELD OF THE INVENTION

This invention relates to an imaging element, and in particular to a silver halide photographic element having a light-insensitive antihalation layer which is located between at least one light-sensitive silver halide emulsion layer and the support, and which contains an ultraviolet ray absorbing polymer particle.

BACKGROUND OF THE INVENTION

An image element, and in particular a silver halide photographic element in general contains an antihalation undercoat layer between the support and the light sensitive silver halide emulsion layer to eliminate or to diminish incident radiation or reflection (halation) exposure on the emulsion layer. An ultraviolet ray absorber is incorporated into such a layer to remove ultraviolet light which can derive from incident reflection or static discharge. Static discharge can occur when the surfaces of the photographic element come into contact during production or treatment processes. Electric charges are generated by friction of separation. When accumulation of static electricity by charging reaches a certain limiting value, atmospheric discharge occurs at a particular moment and a discharge spark fires at the same time. When the photographic element is exposed to light by discharging, static marks appear after development.

Different methods for incorporating an ultraviolet ray absorber into a photographic element have been described in, for example, U.S. Pat. Nos. 2,739,888, 3,215,530, 3,352,681, and 3,707,375, where an oil soluble absorber is dissolved in a high boiling organic solvent, and mixed under high shear or turbulence in an aqueous medium, which may also contain a surfactant, in order to break the organic phase into submicron particles dispersed in the continuous aqueous phase. However, when such dispersions are used in the antihalation undercoat, the layer becomes soft, the cohesion strength of the layer is lowered, and the adhesion between the support and light sensitive emulsion layer becomes poor. Furthermore, even if no high boiling solvent is used, many dyes themselves are liquid, and they therefore can have a detrimental effect on the mechanical properties of the layer and adhesion with the adjacent layer. In order to prevent these problems, a large amount of gelatin must be used in the layer containing ultraviolet ray absorbers.

The reduced adhesion between the support and the emulsion layer or lowered cohesion strength of the antihalation layer due to the presence of ultraviolet ray absorber/high boiling organic solvent dispersions have caused manufacturing difficulties during photographic film finishing and cutting operations. For example, the delaminated emulsion layer generates large pieces of dirt attached physically to the surface of the photographic elements, resulting in the degradation of image quality.

It is known to use in a silver halide photographic element ultraviolet ray absorbing polymer particles obtained by polymerization of ultraviolet ray absorbing monomers. Disadvantages of using such polymer particles are their high cost and poor light stability.

An objective of the present invention is to provide a silver halide photographic element with an antihalation undercoat layer comprising an ultraviolet ray absorber with improved adhesion and cohesion strength, and therefore resistance to dirt generation during manufacturing processes.

SUMMARY OF THE INVENTION

In accordance with the present invention, a silver halide photographic element comprises a support, at least one light sensitive silver halide emulsion layer, and an antihalation undercoat layer interposed between the at least one light sensitive silver halide layer and the support, the antihalation undercoat layer comprising a hydrophilic binder and an ultraviolet ray absorbing polymer particle having a mean size of greater than 0.01 μm, the ultraviolet ray absorbing polymer particle comprising an ultraviolet ray absorber and a polymer derived from monomer A and less than 10 weight % of monomer B, wherein monomer A represents ethylenically unsaturated monomers which form substantially water insoluble homopolymers, and monomer B represents ethylenically unsaturated monomers capable of forming water soluble homopolymers.

DETAILED DESCRIPTION OF THE INVENTION

Photographic elements according to this invention can differ widely in structure and composition. For example, they can vary in regard to the type of the support, the number and composition of the imaging forming layers, and the kinds of auxiliary layers that are included in the elements. The invention is particularly applicable to photographic elements comprising polymeric film supports. Typical polymeric film supports include cellulose nitrate film, cellulose acetate film, poly(vinyl acetal) film, polystyrene film, polyester film such as poly(ethylene terephthalate) film and poly(ethylene naphthalate) film, polycarbonate film, and the like. Polymeric supports may be annealed or not.

The photographic element of the present invention has a light-insensitive antihalation undercoat layer located between the support and the light-sensitive emulsion layer. The support can be treated with other adhesion promotion undercoat layers before applying the antihalation undercoat layer. For example, a polyester film support can employ an undercoat layer that comprises a vinylidene chloride/acrylonitrile/acrylic acid terpolymer and an undercoat layer that comprise gelatin. The antihalation undercoat layer comprises a hydrophilic binder and an ultraviolet ray absorbing polymer particle. The weight ratio of ultraviolet ray absorbing particle to hydrophilic binder in the antihalation undercoat layer ranges from 5:95 to 80:20, preferably from 10:90 to 60:40, and most preferably from 10:90 to 50:50. The thickness of the antihalation undercoat layer ranges from 0.1 to 6 μm, and preferably from 0.3 to 4 μm, and most preferably from 0.5 to 3 μm. The term of "thickness" used here refers to the thickness measured, for example, by an electron micrograph of a non-swollen cross-section of the light insensitive material.

The ultraviolet ray absorbing polymer particles of the present invention comprise a polymer and an ultraviolet ray absorber, and having a mean size of greater than 0.01 μm, preferably from 0.01 to 10 μm, and most preferably from 0.02 to 0.5 μm. The polymers contained in the ultraviolet ray absorbing particle comprise units derived from monomer A and less than 10 weight % of monomer B, where A represents ethylenically unsaturated monomers which form substantially water insoluble homopolymers, and B represents ethylenically unsaturated monomers capable of forming water soluble homopolymers. Preferably, the polymer has a glass transition temperature of greater than 40 ° C. In general, the weight ratio of ultraviolet absorber to polymer in the ultraviolet ray absorbing particle can be anywhere within the range of 1:40 to 3:1, preferably from about 1:10 to 2:1, and most preferably from about 1:5 to 1:1.

Any suitable ethylenically unsaturated monomers may be used for the preparation of the polymers contained in the ultraviolet ray absorbing polymer particles of the present invention as long as the stated glass transition temperature requirement and monomer ratios and percentages are maintained. In accordance with the invention, A represents "hydrophobic monomers" which would form a substantially water insoluble homopolymer, and B represents "hydrophilic monomers" which are capable of forming substantially water soluble homopolymers.

Suitable ethylenically unsaturated monomers which can be used as component A of the present invention include, for example, the following monomers and their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the ultraviolet ray absorbing polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

Suitable ethylenically unsaturated nonionic hydrophilic monomers which can be used as component B of the present invention include, for example, (meth)acrylamides such as acrylamide, methacrylamide, N,N-dimethyl acrylamide, N-methylol acrylamide, and isopropyl acrylamide. Additional suitable hydrophilic monomers include poly(ethylene glycol)(meth)acrylates, N-vinyl-2-pyrrolidone, vinylimidazole, and the like.

Ethylenically unsaturated ionic monomers which can be used as component B of the present invention include, for example, monomers containing carboxylic acid, sulfo, or oxysulfo pendent groups, or salts of such groups. Representative monomers include acrylic acid, methacrylic acid, and sodium acrylamido-2-methylpropane sulfonate.

The types of ultraviolet ray absorbers which can be used for the practice of the present invention are not particularly limited provided their absorption maximum wavelengths fall within the range of 300 to 400 nm, and they have no harmful effect on the imaging properties of the element. Such UV absorbers include ultraviolet absorbers of the thiazolidone type, the benzotriazole type, the cinnamic acid ester type, the benzophenone type, and the aminobutadiene type and have been described in detail in, for example, U.S. Pat. Nos. 1,023,859, 2,685,512, 2,739,888, 2,748,021, 3,004,896, 3,052,636, 3,215,530, 3,253,921, 3,533,794, 3,692,525, 3,705,805, 3,707,375, 3,738,837, 3,754,919, and British Patent No 1,321,355.

A preferred ultraviolet ray absorber useful for the practice of the present invention is represented by formula I.

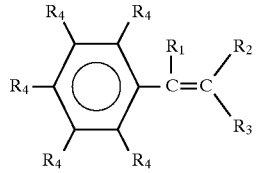

(I)

wherein $R_4$ may be the same or different, and each represents a hydrogen atom, a halogen atom, an alkyl, an aryl group having from 6 to 20 carbon atoms, an alkoxy group, an aryloxy, an alkylthio group, an arylthio group, an amine group, an alkylamino group, an arylamino group, an hydroxyl group, a cyano group, a nitro group, an acylamino group, a sulfonyl group, a sulfoamido group, an acyloxy group, or an oxycarbonyl group, or two neighboring R groups may form a 5- or 6-member ring by ring closure. $R_1$ represents a hydrogen atom, or an alkyl group. $R_2$ or $R_3$ each represents a cyano group, —$COOR_9$, —CO—$NHR_9$, —$SO_2R_9$, CO—$R_9$, where $R_9$ represents an alkyl group, and an aryl group.

Most preferred ultraviolet ray absorbers represented by formula I are given by formula II.

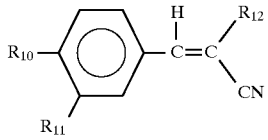

(II)

The following represents limited examples of compounds given by formula II.

| Compound No. | $R_{10}$ | $R_{11}$ | $R_{12}$ |
|---|---|---|---|
| UV-44 | H | H | $CO_2C_{16}H_{33}$ |
| UV-45 | $CH_3$ | H | $CO_2C_{16}H_{33}$ |
| UV-3 | $CH_3$ | H | $CO_2C_3H_7$ |
| UV-4 | $CH_3$ | H | $CO_2C_{12}H_{25}$ |
| UV-5 | $CH_3$ | H | $SO_2C_{12}H_{25}$ |
| UV-6 | $OCH_3$ | H | $CO_2C_3H_7$ |
| UV-7 | $OCH_3$ | H | $CO_2C_5H_{11}$ |
| UV-8 | $OCH_3$ | H | 2-ethylhexyl |
| UV-9 | $OCH_3$ | H | $CO_2C_8H_{17}$ |
| UV-10 | $OCH_3$ | H | $CO_2C_9H_{19}$ |
| UV-11 | $OCH_3$ | H | $CO_2C_{10}H_{21}$ |
| UV-12 | $OCH_3$ | H | $CO_2C_{12}H_{25}$ |
| UV-13 | $OCH_3$ | H | $CO_2C_{16}H_{33}$ |
| UV-14 | $OCH_3$ | H | $CO_2C_{18}H_{37}$ |
| UV-15 | $OCH_3$ | H | $SO_2C_{12}H_{25}$ |
| UV-16 | $OCH_3$ | H | $SO_2C_{10}H_{21}$ |
| UV-17 | $OCH_3$ | H | $SO_2C_8H_{17}$ |
| UV-18 | $OCH_3$ | H | $SO_2C_6H_{13}$ |
| UV-19 | $OCH_3$ | H | $SO_2C_4H_9$ |
| UV-20 | $OCH_3$ | H | $SO_2C_3H_7$ |
| UV-21 | $OCH_3$ | H | $SO_2CH_3$ |
| UV-22 | $OC_3H_7$ | H | $CO_2C_3H_7$ |
| UV-22 | $OC_3H_7$ | H | $CO_2C_5H_{11}$ |
| UV-23 | $OC_3H_7$ | H | 2-ethylhexyl |
| UV-24 | $OC_3H_7$ | H | $CO_2C_8H_{17}$ |
| UV-25 | $OC_3H_7$ | H | $CO_2C_9H_{19}$ |
| UV-26 | $OC_3H_7$ | H | $CO_2C_{10}H_{21}$ |
| UV-27 | $OC_3H_7$ | H | $CO_2C_{12}H_{25}$ |
| UV-28 | $OC_3H_7$ | H | $CO_2C_{16}H_{33}$ |
| UV-29 | $OC_3H_7$ | H | $CO_2C_{18}H_{37}$ |
| UV-30 | $OC_3H_7$ | H | $SO_2C_{12}H_{25}$ |
| UV-31 | $OC_3H_7$ | H | $SO_2C_{10}H_{21}$ |
| UV-32 | $OC_3H_7$ | H | $SO_2C_8H_{17}$ |
| UV-33 | $OC_3H_7$ | H | $SO_2C_6H_{13}$ |
| UV-34 | $OC_3H_7$ | H | $SO_2C_4H_9$ |
| UV-35 | $OC_3H_7$ | H | $SO_2C_3H_7$ |

-continued

| Compound No. | $R_{10}$ | $R_{11}$ | $R_{12}$ |
|---|---|---|---|
| UV-36 | $OC_3H_7$ | H | $SO_2CH_3$ |
| UV-37 | $OC_2H_5$ | $OCH_3$ | $CO_2C_2H_5$ |
| UV-38 | $OC_4H_9$ | $OCH_3$ | $CO_2C_2H_5$ |
| UV-39 | $OC_6H_5$ | $OCH_3$ | $CO_2C_2H_4OH$ |
| UV-40 | $OCH_2C_6H_5$ | OH | $CO_2C_2H_5$ |
| UV-41 | $OC_6H_5$ | $OCH_3$ | $CO_2C_2H_5$ |
| UV-42 | $OCH_2OCO_2C_2H_5$ | $OCH_3$ | $CONHC_6H_5$ |
| UV-43 | $OC_2H_4OCOCH_3$ | $OCH_3$ | $CONHCH_2C_6H_5$ |

A second preferred ultraviolet ray absorber for the practice of the present invention has structures given by formula III:

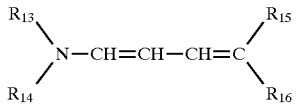

(III)

where $R_{13}$, and $R_{14}$, which may be the same or different, each represents a hydrogen atom, an alkyl group, an aryl group, $R_{15}$ and $R_{16}$ each represents a cyano group, —$COOR_{17}$, $COR_{17}$, $SO_2R_{17}$, where $R_{17}$ represents an alkyl group, or an aryl group.

A third preferred ultraviolet ray absorber for the practice of the present invention is represented by formula IV:

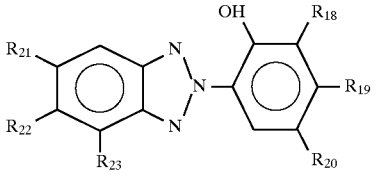

(IV)

where $R_{18}$, $R_{19}$, $R_{20}$, $R_{21}$, $R_{22}$, and $R_{23}$ may be the same or different, and each represents a hydrogen atom, a halogen atom, a nitro group, a hydroxyl group, an alkyl group, an aryl group, an alkoxy group, an aryloxy group, an alkylthio group, an arylthio group, an aralkylthio group, an akoxycarbonyl group, a carbamoyl group, an alkylsulfonyl group, a mono or dialkylamino group, etc.

The ultraviolet ray absorbing polymer particles of this invention can be made by various well-known techniques in the art, such as, for example, emulsion polymerization, dispersion polymerization, suspension polymerization, and the like (see, for example, Padget, J. C. *Journal of Coating Technology*, Vol 66, No. 839, pages 89–105, 1994; El-Aasser, M. S. and Fitch, R. M. Ed. *Future Directions in Polymer Colloids*, NATO ASI Series, No 138, Martinus Nijhoff Publishers, 1987; Arshady, R. *Colloid & Polymer Science,* 1992, No 270, pages 717–732; Odian, G. *Principles of Polymerization,* 2nd Ed. Wiley (1981); and Sorenson, W. P. and Campbell, T. W. *Preparation Method of Polymer Chemistry,* 2nd Ed, Wiley (1968)).

A preferred method of preparing ultraviolet ray absorbing polymer particles in accordance with this invention is by a limited coalescence technique where a mixture of polymerizable monomers and ultraviolet ray absorbers is added to an aqueous medium containing a particulate suspending agent to form a discontinuous (oil droplet) phase in continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference.

A second preferred method of preparing ultraviolet ray absorbing polymer particles in accordance with this invention is by an emulsion polymerization process where an ultraviolet ray absorber is mixed with an ethylenically unsaturated monomer or its mixture together with a water soluble initiator and a surfactant. The polymerization process is initiated in general with free radical initiators. Free radicals of any sort may be used. Preferred initiators include persulfates (such as ammonium persulfate, potassium persulfate, etc.), peroxides (such as hydrogen), azo compounds (such as azobiscyanovaleric acid), and redox initiators (such as hydrogen peroxide-iron(II) salt, potassium persulfate-sodium hydrogen sulfate, etc.). Surfactants which can be used include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

The ultraviolet ray absorbing polymer particle of the invention can also be prepared by loading an ultraviolet ray absorber into a pre-formed latex particle as described in, for example, U.S. Pat. Nos. 4,199,363, 4,304,769, 4,247,627, 4,368,258, and 5,536,628. The loading process described in U.S. Pat. No. 5,536,628 does not use organic solvents, therefore is particularly preferred, in which a polymer latex of known solids is heated with stirring to 70° to 80° C. An ultraviolet ray absorber is heated until it reaches its liquid state and is mixed with the preheated polymer latex at high shear to generate an emulsion. The emulsion is then passed through a high energy homogenizer at least once to form an ultraviolet ray absorber impregnated latex polymer dispersion. In the process, a water soluble polymeric steric stabilizer can be used to assist the loading and the stability of resultant dispersion. Such water soluble polymeric compounds include gelatin, poly(vinyl alcohol), poly(vinyl pyrrolidone), and the like.

Any suitable hydrophilic binder can be used in practice of this invention, such as naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

The antihalation layer may include other addenda, for example, processing survival or non-processing survival visible light absorbing compounds, colloidal filamentary metallic silvers, sequestration agents, thickners, hardeners, coating aids, polymer particles, and inorganic oxide particles.

The photographic element of the present invention can contain at least one electrically conductive layer, which can be either surface protective layer or a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The antihalation undercoat layer of the invention can be applied by any of a number of well-know techniques, such as dip coating, rod coating, blade coating, air knife coating, gravure coating and reverse roll coating, extrusion coating, slide coating, curtain coating, and the like. The core/shell polymer particles and the binder are mixed together in an aqueous medium to form a coating composition. After coating, the layer is generally dried by simple evaporation, which may be accelerated by known techniques such as convection heating. Known coating and drying methods are described in further detail in Research Disclosure No. 308119, Published December 1989, pages 1007 to 1008.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present-invention will now be described in detail with reference to examples; however, the present invention should not limited by these examples.

The ultraviolet ray absorbers used in the coating examples have the following structures:

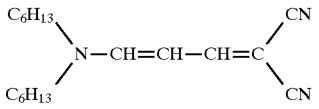

(UV-1)

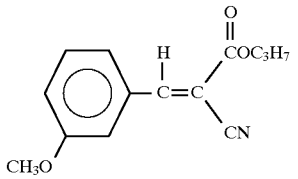

(UV-2)

UV-D1 and UV-D2 are prepared by first dissolving UV-1 and UV-2, respectively, in a high boiling organic solvent, and the resultant solutions are then dispersed in aqueous gelatin solutions by using a homogenizer at 3500 psi and at 45° C. The dispersions are used to form coating solution in the comparative coating examples.

UV-D3 is prepared in a similar manner as UV-D1 and UV-D2 except it contains both UV-1 and UV-2 at a weight ratio of 1:1.

The ultraviolet ray absorbing polymer particle PUV-1 is prepared by loading UV-1 and UV-2 at a weight ratio of 0.9:1 into of a poly(ethyl methacrylate-co-sodium 2-acrylamido-2-methylpropane sulfonate) (95/5 wt %) latex prepared by emulsion polymerization. The latex has a particle size of about 95 nm. The ultraviolet ray absorbing polymer particle has a polymer to UV absorber ratio of 2:1 by weight.

EXAMPLES

Examples 1–3

Photographic Elements

A series of photographic elements are prepared as follows: An acetate support is used having an antistatic layer overcoated with a transparent barrier/abrasion resistance layer on the other side. The support is coated on the side opposite to the antistatic layer with the antihalation layer having compositions as follows:

Example 1

(Comparative)

The antihalation layer is prepared using UV-D1 and UV-D2 dispersions and comprises gelatin (1.6 g/m$^2$), filamentary metallic silver (0.15 g/m$^2$), compound AHU-1 (0.0253 g/m$^2$), AHU-2 (0.13 g/m$^2$), AHU-3 (0.0108 g/m$^2$), S-1 (0.086 g/m$^2$), triethylhexyl phosphate (0.0108 g/m$^2$), UV-1 (0.108 g/m$^2$), UV-2 (0.108 g/m$^2$), and S-4 (0.216 g/m$^2$).

Example 2

(Comparative)

The antihalation layer is prepared using UV-D3 dispersion and comprises gelatin (1.6 g/m$^2$), filamentary metallic silver (0.15 g/m$^2$), compound AHU-1 (0.0253 g/m$^2$), AHU-2 (0.13 g/m$^2$), AHU-3 (0.0108 g/m$^2$), S-1 (0.086 g/m$^2$), triethylhexyl phosphate (0.0108 g/m$^2$), UV-1 (0.108 g/m$^2$), UV-2 (0.108 g/m$^2$), and S-1 (0.151 g/m$^2$).

Example 3

(Invention)

The antihalation layer is prepared using PUV-1 ultraviolet ray absorbing polymer particle dispersion and comprises gelatin (1.6 g/m$^2$), filamentary metallic silver (0.15 g/m$^2$), compound AHU-1 (0.0253 g/m$^2$), AHU-2 (0.13 g/m$^2$), AHU-3 (0.0108 g/m$^2$), S-1 (0.086 g/m$^2$), triethylhexyl phosphate (0.0108 g/m$^2$), UV-1 (0.0.0972 g/m$^2$), UV-2 (0.108 g/m$^2$), and poly(ethyl methacrylate-co-sodium 2-acrylamido-2-methylpropane sulfonate) (95/5 wt %, 0.409 g/m$^2$).

The above photographic element Examples 1–3 may optionally contain sequestrant agents, antifoggants, dyes, coating aids and the like.

The above photographic element Examples 1–3 are then coated on the top of the antihalation layer with the following layers:

Interlayer: This layer comprises compound 2,5-di-t-octyl-1, 4-dihydroxy benzene (0.075 g/m$^2$), tri(2-ethylhexyl) phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 $\mu$m grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 $\mu$m grain size) (0.816 g/m$^2$ silver) and a red sensitive, tabular grain, silver bromoiodide emulsion (4.5 mole percent iodide) (0.98 $\mu$m diameter by 0.11 $\mu$m thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 $\mu$m diameter by 0.11 $\mu$m thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g./m$^2$).

Interlayer: This layer comprises compound 2,5-di-t-octyl-1, 4-dihydroxy benzene (0.075 g/m$^2$), tri(2-ethylhexyl) phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 $\mu$m diameter by 0.112 $\mu$m thick) (0.258 g/m$^2$ Ag), and a green sensitive, tabular grain, silver bromoiodide emulsion (1.3 mole percent iodide) (0.54 $\mu$m diameter by 0.086 $\mu$m thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 $\mu$m diameter by 0.12 $\mu$m thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 $\mu$m diameter by 0.113 $\mu$m thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-t-octyl-1, 4-dihydroxy benzene (0.075 g/m$^2$), YD-2 (0.108 g/m$^2$), Irganox 1076 sold by Ciba-Geigy (0.01 g/m$^2$), S-2 (0.121 g/m$^2$), and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 $\mu$m diameter by 0.131 $\mu$m thick) (0.161 g/m$^2$ Ag), a blue sensitive, tabular grain, silver bromoiodide emulsion (1.5 mole percent iodide) (0.85 $\mu$m diameter by 0.131 $\mu$m thick) (0.0.108 g/m$^2$ Ag), and a blue sensitive, tabular grain, silver bromoiodide emulsion (1.3 mole percent iodide) (0.54 $\mu$m diameter by 0.086 $\mu$m thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 $\mu$m diameter by 0.128 $\mu$m thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

Second Protective Layer: This layer comprises gelatin (0.7 g/m$^2$), colloidal silver (0.215 g/m$^2$), UV-1 (0.108 g/m$^2$), UV-2 (0.108 g/m$^2$), and S-1 (0.151 g/m$^2$).

First Protective Layer: This layer comprises Gelatin (0.888 g/m$^2$) Silicone lube (DC-200 Dow Corning, 0.0401 g/m$^2$), Fluorad FC-134 (3M Co., 0.0039 g/m$^2$), Aerosol OT (American Cyanamide, 0.0215 g/m$^2$), Surfactant Olin 10G (Olin Corp., 0.0272 g/m$^2$), Poly(methyl methacrylate) matte (1.5 $\mu$m, 0.0538 g/m$^2$), and Poly (methyl methacrylate-co-methacrylic acid) (45/55 wt %, 2.7 $\mu$m, 0.107 g/m$^2$).

Y1
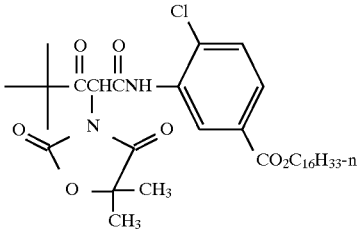
IR-1
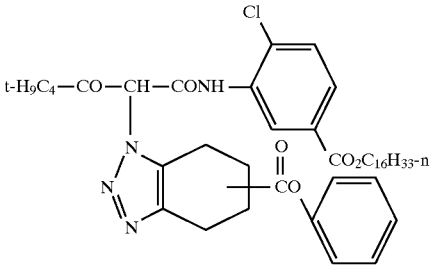
YD-2
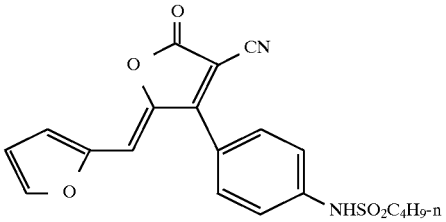
ST-1
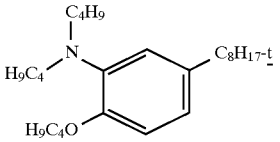
IR-2
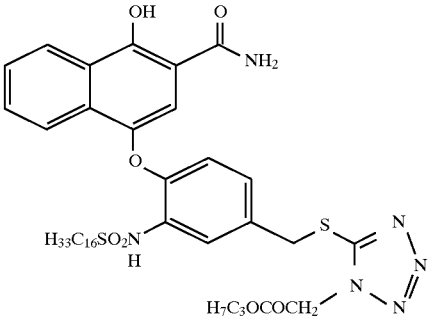
IR-3
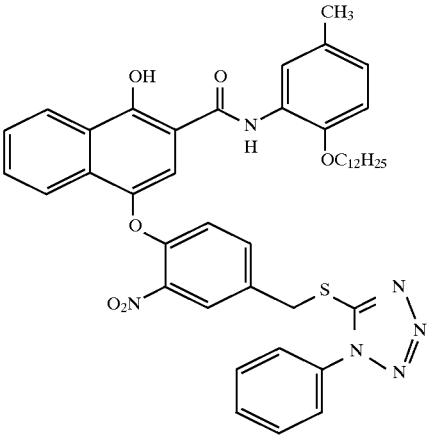

-continued
IR-4
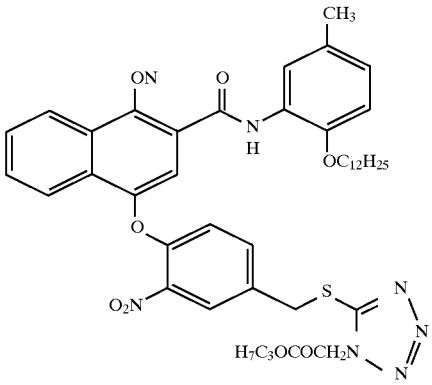
B-1
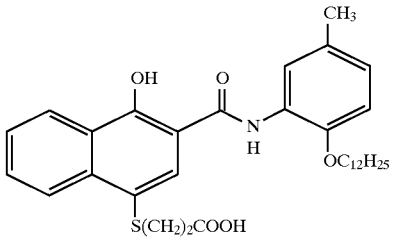
M-1
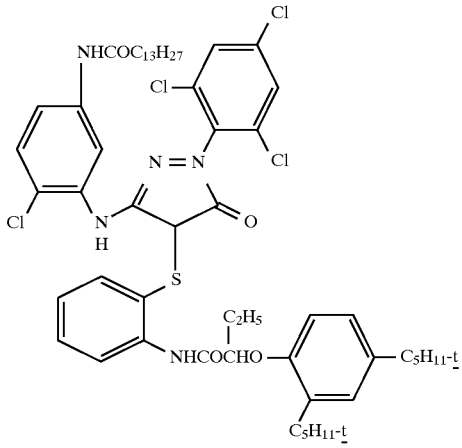
MM-1
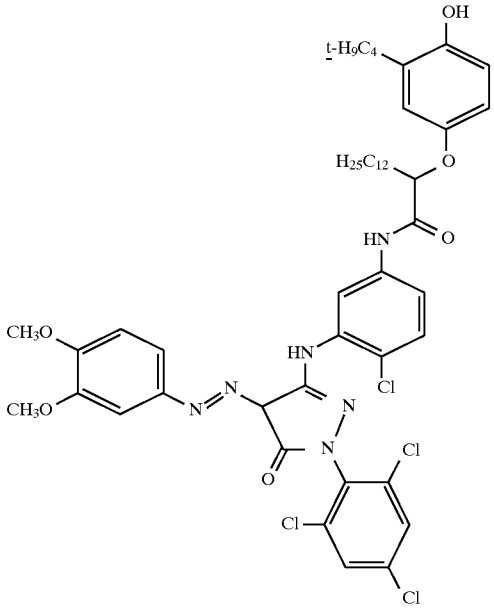

-continued
CC-1
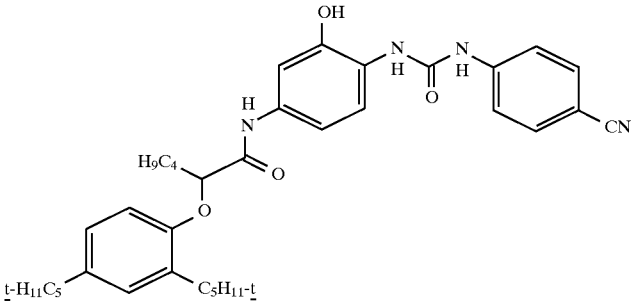
CM-1
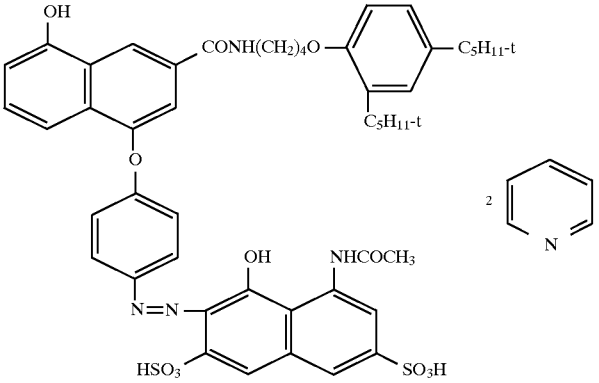
S-1
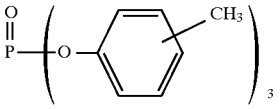
S-2
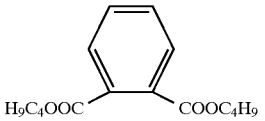
S-3
$C_{11}H_{23}CON(C_2H_5)_2$
S-4
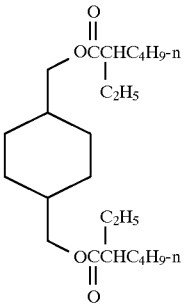
S-5
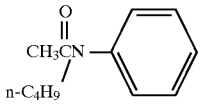

-continued

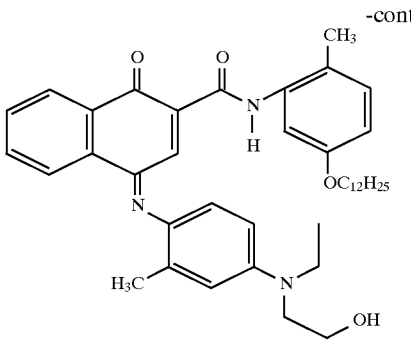

AHU-1

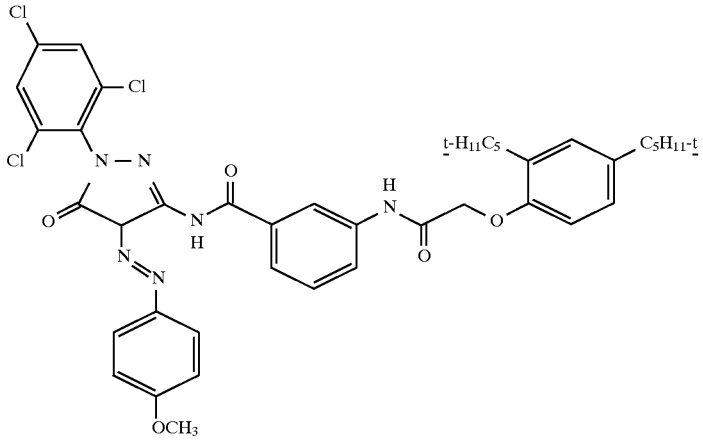

AHU-2

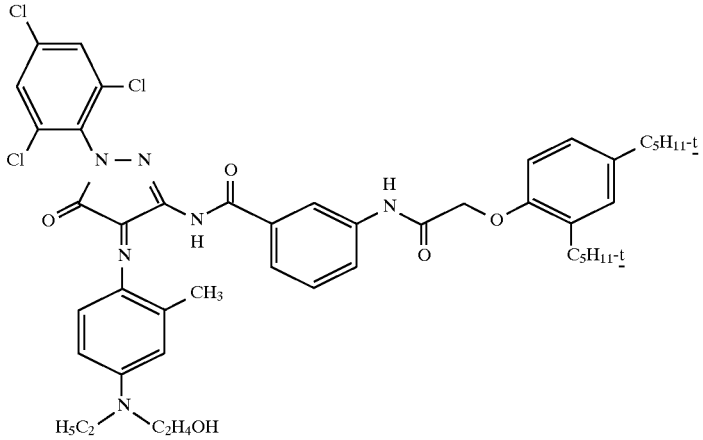

AHU-3

Evaluation of Adhesion and Cutting Quality

A 16 mm wide strip of film is placed, emulsion up, on a metal block with machined horizontal and vertical surfaces which meet in a straight line, such that the film strip protrudes over the vertical surface. A cutting blade, situated such that the blade is parallel to the vertical surface and has essentially zero clearance with the vertical surface, is passed through the film sample, from top to bottom, at a speed of 38.0 cm/sec (15 inches/sec). Cross sections of the resulting edges are examined by optical microscope for quality of cut in terms of emulsion delamination (adhesion) and dirt generated (cutting quality). They are rated by the following scale: A=no delamination or dirt seen, B=very low amount of delamination or dirt, C=moderate amount of delamination or dirt, and D=large amount of delamination or dirt. The results are shown in Table 1.

| Coating Examples | Delamination | Dirt |
|---|---|---|
| Example 1 (Comparison) | D | D |
| Example 2 (Comparison) | B | C |
| Example 3 (Invention) | A | A |

The above examples demonstrate that the photographic element prepared in accordance with the present invention has excellent adhesion and cutting quality.

The invention has been described in detail with particular reference to certain preferred embodiments thereof, but it will be understood that variations and modifications can be effected within the spirit and scope of the invention.

What is claimed is:

1. A silver halide photographic element comprising:

a support;

at least one light sensitive silver halide emulsion layer; and a light-insensitive antihalation undercoat, interposed between said at least one light sensitive silver halide emulsion layer and said support, the light-insensitive antihalation undercoat layer comprising a hydrophilic binder and an ultraviolet ray absorbing polymer particle having a mean size of greater than 0.01 $\mu$m, the ultraviolet ray absorbing polymer particle comprising an ultraviolet ray absorber and a polymer derived from monomer A and less than 10 weight percent of monomer B, wherein monomer A represents ethylenically unsaturated monomers which form substantially water insoluble homopolymers, and monomer B represents ethylenically unsaturated monomers capable of forming water soluble homopolymers wherein the polymer has a glass transition temperature of greater than 40° C.

2. The photographic element of claim 1 wherein monomer A is selected from the group consisting of alkyl esters of acrylic acid, alkyl esters of methacrylic acid, hydroxyalkyl esters of acrylic acid, hydroxyalkyl esters of methacrylic acid, nitrites of acrylic acid, nitrites of methacrylic acid, amides of acrylic acid, amides of methacrylic acid, vinyl acetate, vinyl propionate, vinylidene chloride, vinyl chloride, styrene, t-butyl styrene, ethyl vinyl benzene, vinyl toluene, dialkyl maleates, dialkyl itaconates, dialkyl malonates, isoprene, and butadiene.

3. The photographic element of claim 1 wherein monomer B is selected from the group consisting of (meth) acrylamides, poly(ethylene glycol)(meth)acrylates, N-vinyl-2-pyrrolidone, vinylimidazole, acrylic acid, methacrylic acid, and sodium acrylamido-2-methylpropane sulfonate.

4. The photographic element of claim 1 wherein the polymer further comprises crosslinking monomers selected from the group consisting of allyl methacrylate, allyl acrylate, butenyl acrylate, undecenyl acrylate, undecenyl methacrylate, vinyl acrylate, vinyl methacrylate, butadiene, isoprene, ethylene glycol diacrylate, ethylene glycol dimethacrylate, triethylene glycol dimethacrylate, 1,4-butanediol dimethacrylate, 1,3-butanediol dimethacrylate, and divinyl benzene.

5. The photographic element of claim 1 wherein the ultraviolet ray absorber comprises a compound represented by formula I:

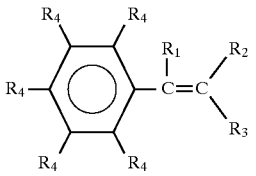

(I)

wherein $R_4$, is each independently selected from the group consisting of a hydrogen, a halogen, an alkyl group, an aryl group having from 6 to 20 carbon atoms, an alkoxy group, an aryloxy, an alkylthio group, an arylthio group, an amine group, an alkylamino group, an arylamino group, an hydroxyl group, a cyano group, a nitro group, an acylamino group, a sulfonyl group, a sulfoamido group, an acyloxy group, or an oxycarbonyl group, or two neighboring $R_4$ groups may form a 5- or 6-member ring by ring closure, $R_1$ represents a hydrogen atom, or an alkyl group, $R_2$ and $R_3$ each represents a cyano group, —$COOR_9$, —CO—$NHR_9$, —$SO_2R_9$, CO—$R_9$, where $R_9$ represents an alkyl group, and an aryl group.

6. The photographic element of claim 1 wherein the ultraviolet ray absorber comprises a compound represented by formula III:

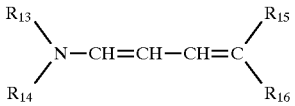

(III)

where $R_{13}$, and $R_{14}$, each represents a hydrogen atom, an alkyl group, an aryl group, $R_{15}$ and $R_{16}$ each represents a cyano group, —$COOR_{17}$, $COR_{17}$, $SO_2R_{17}$, where $R_{17}$ represents an alkyl group, or an aryl group.

7. The photographic element of claim 1 wherein the ultraviolet ray absorber comprises a compound represented by formula IV:

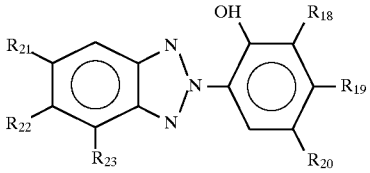

(IV)

where $R_{18}$, $R_{19}$, $R_{20}$, $R_{21}$, $R_{22}$, and $R_{23}$ each represents a hydrogen atom, a halogen atom, a nitro group, a hydroxyl group, an alkyl group, an aryl group, an alkoxy group, an aryloxy group, an alkylthio group, an arylthio group, an aralkylthio group, an akoxycarbonyl group, a carbamoyl group, an alkylsulfonyl group, a monoalkylamino group or dialkylamino group.

8. The photographic element of claim 1 wherein said support is selected from the group consisting of cellulose nitrate film, cellulose acetate film, poly(vinyl acetal) film, polystyrene film, poly(ethylene terephthalate) film, poly (ethylene naphthalate) film and polycarbonate film.

9. The photographic element of claim 1 wherein the light insensitive anithalation undercoat further comprises processing surviving visible light absorbing compounds, non-processing surviving visible light absorbing compounds, colloidal filamentary metallic silvers, sequestration agents, thickeners, hardeners, coating aids, polymer particles, or inorganic oxide particles.

10. The photographic element of claim 1 further comprising at least one electrically conductive layer.

11. The photographic element of claim 1 further comprising a transparent magnetic recording layer.

12. The photographic element of claim 1 wherein the hydrophilic binder is selected from the group consisting of proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, alkyl polymers, and sulfoalkyl acrylates polymers, methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, and copolymers containing styrene sulfonic acid.

* * * * *